US005926112A

United States Patent [19]

Hartzell

[11] Patent Number: 5,926,112

[45] Date of Patent: Jul. 20, 1999

[54] EMERGENCY VEHICLE WARNING SYSTEM

[76] Inventor: Chris Hartzell, P.O. Box 223174, Carmel, Calif. 93922

[21] Appl. No.: 08/903,208

[22] Filed: Jul. 21, 1997

[51] Int. Cl.[6] ..... G08G 1/00

[52] U.S. Cl. ..... 340/902; 340/436; 340/904; 340/691.6; 340/693.5

[58] Field of Search ..... 340/436, 902, 340/691.6, 692, 693.5, 904

[56] References Cited

U.S. PATENT DOCUMENTS

| | | | |
|---|---|---|---|
| 3,233,217 | 2/1966 | Bost | 340/902 |
| 3,710,313 | 1/1973 | Kimball et al. | 340/902 |
| 4,785,282 | 11/1988 | Martell et al. | 340/902 |
| 4,952,931 | 8/1990 | Serageldin et al. | 340/902 |
| 5,559,495 | 9/1996 | Cochran | 340/575 |
| 5,572,201 | 11/1996 | Graham et al. | 340/902 |

*Primary Examiner*—Daniel J. Wu

[57] ABSTRACT

A new Emergency Vehicle Warning System for warning vehicles of the approach of an emergency vehicle. The inventive device includes a receiver which provides both a visual message warning of an approaching emergency vehicle but also an additional flashing indicator light. The receiver also provides an audible warning signal which is selectively controlled by a button on the receiver. An alternate receiver is provided which includes the pictures of a plurality of different emergency vehicles and a flashing indicator associated with each vehicle. When the receiver receives a signal transmitted by an emergency vehicle, the flashing light of the corresponding emergency vehicle on the receiver is activated, thus indicating what type of emergency vehicle is approaching.

7 Claims, 4 Drawing Sheets

EMERGENCY VEHICLE WARNING SYSTEM

BACKGROUND OF THE INVENTION

1. Field of the Invention

The present invention relates to vehicle warning systems and more particularly pertains to a new Emergency Vehicle Warning System for warning vehicles of the approach of an emergency vehicle.

2. Description of the Prior Art

The use of vehicle warning systems is known in the prior art. More specifically, vehicle warning systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art vehicle warning systems include U.S. Pat. No. 5,307,060; U.S. Pat. No. 4,587,522; U.S. Pat. No. Des. 351,805; U.S. Pat. No. 4,764,978; U.S. Pat. No. 4,443,790 and U.S. Pat. No. 4,438,429.

Specifically, while these systems generally teach the concept of an emergency vehicle transmitting a warning signal which is received by a vehicle mounted receiver to provide warning signals, none of these references focus on the adequacy of the warning signal provided to the driver and whether the driver is able to readily receive and control the signal(s).

While these devices fulfill their respective, particular objectives and requirements, the aforementioned patents do not disclose a new Emergency Vehicle Warning System. The inventive device includes a receiver which provides both a visual message warning of an approaching emergency vehicle but also an additional flashing indicator light. The receiver also provides an audible warning signal which is selectively controlled by a button on the receiver.

In these respects, the Emergency Vehicle Warning System according to the present invention substantially departs from the conventional concepts and designs of the prior art, and in so doing provides an apparatus primarily developed for the purpose of warning vehicles of the approach of an emergency vehicle.

SUMMARY OF THE INVENTION

In view of the foregoing disadvantages inherent in the known types of vehicle warning systems now present in the prior art, the present invention provides a new Emergency Vehicle Warning System construction wherein the same can be utilized for warning vehicles of the approach of an emergency vehicle.

The general purpose of the present invention, which will be described subsequently in greater detail, is to provide a new Emergency Vehicle Warning System apparatus and method which has many of the advantages of the vehicle warning systems mentioned heretofore and many novel features that result in a new Emergency Vehicle Warning System which is not anticipated, rendered obvious, suggested, or even implied by any of the prior art vehicle warning systems, either alone or in any combination thereof.

To attain this, the present invention generally comprises a receiver which provides both a visual message warning of an approaching emergency vehicle but also an additional flashing indicator light. The receiver also provides an audible warning signal which is selectively controlled by a button on the receiver.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Emergency Vehicle Warning System apparatus and method which has many of the advantages of the vehicle warning systems mentioned heretofore and many novel features that result in a new Emergency Vehicle Warning System which is not anticipated, rendered obvious, suggested, or even implied by any of the prior art vehicle warning systems, either alone or in any combination thereof.

It is another object of the present invention to provide a new Emergency Vehicle Warning System which may be easily and efficiently manufactured and marketed.

It is a further object of the present invention to provide a new Emergency Vehicle Warning System which is of a durable and reliable construction.

An even further object of the present invention is to provide a new Emergency Vehicle Warning System which is susceptible of a low cost of manufacture with regard to both materials and labor, and which accordingly is then susceptible of low prices of sale to the consuming public, thereby making such Emergency Vehicle Warning System economically available to the buying public.

Still yet another object of the present invention is to provide a new Emergency Vehicle Warning System which provides in the apparatuses and methods of the prior art some of the advantages thereof, while simultaneously overcoming some of the disadvantages normally associated therewith.

Still another object of the present invention is to provide a new Emergency Vehicle Warning System for warning vehicles of the approach of an emergency vehicle.

Yet another object of the present invention is to provide a new Emergency Vehicle Warning System which includes a receiver which provides both a visual message warning of an approaching emergency vehicle but also an additional flashing indicator light. The receiver also provides an audible warning signal which is selectively controlled by a button on the receiver.

Still yet another object of the present invention is to provide a new Emergency Vehicle Warning System that reduces accidents between emergency vehicles and non-emergency vehicles.

Even still another object of the present invention is to provide a new Emergency Vehicle Warning System that provides an improved signal to a driver thus increasing warning time.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
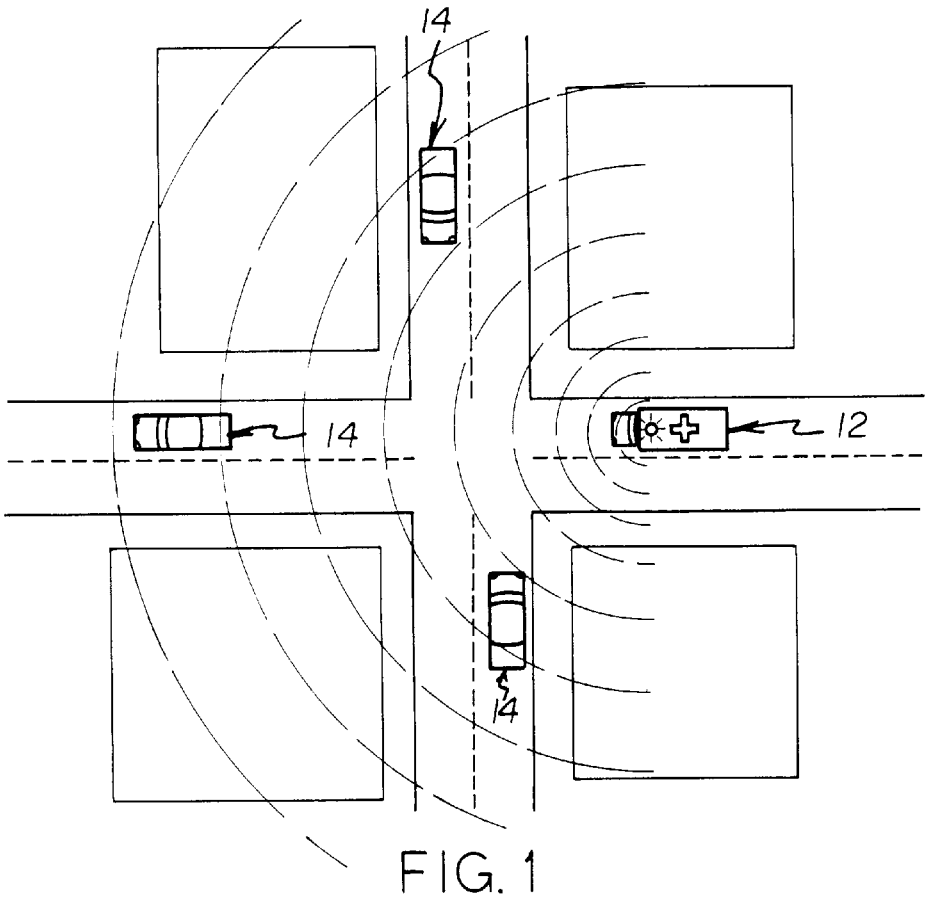
FIG. 1 is a top view of a new Emergency Vehicle Warning System in an exemplary operating scene according to the present invention.
Figure 2:
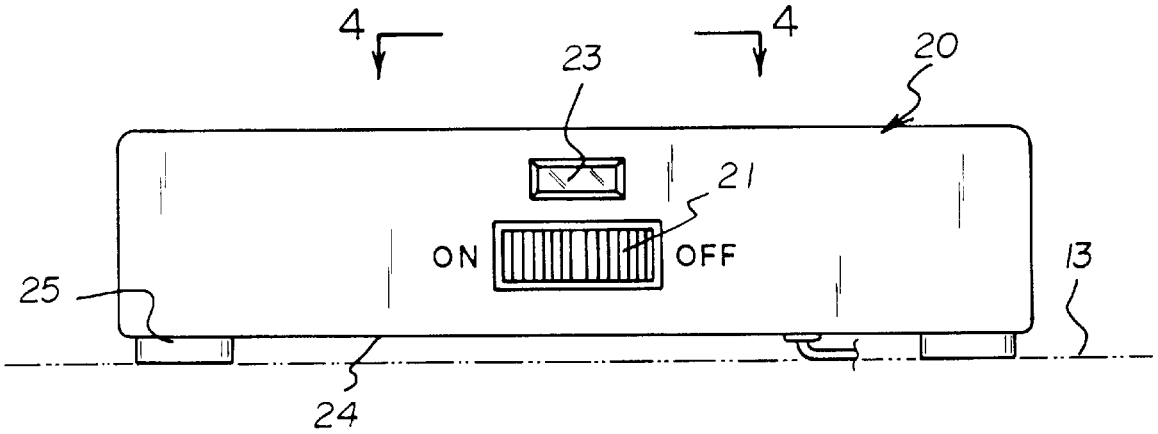
FIG. 2 is a front view of the signal transmitter.
Figure 3:
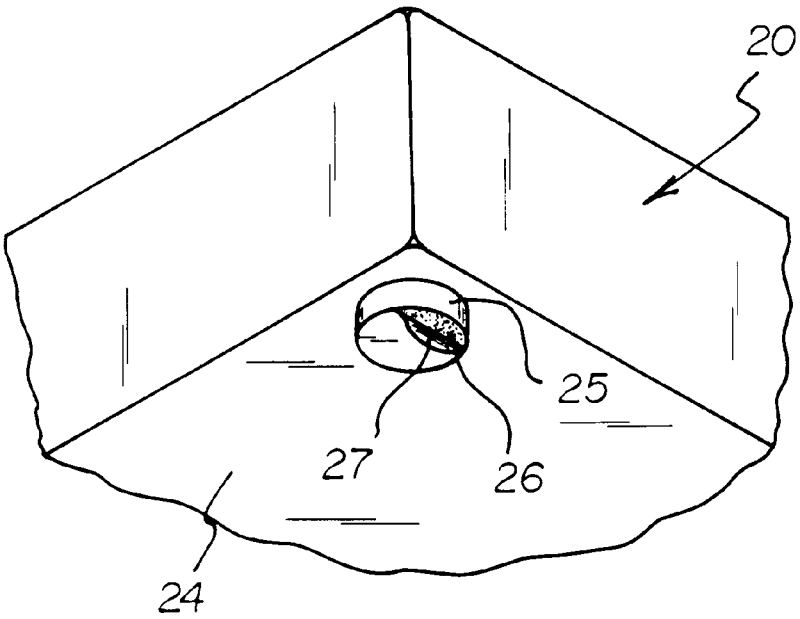
FIG. 3 is a partial perspective bottom view of the transmitter.
Figure 4:
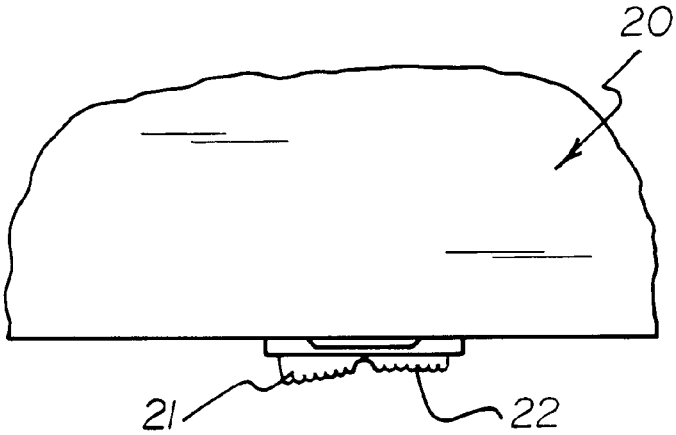
FIG. 4 is a view taken along line 4—4 of FIG. 2.
Figure 5:
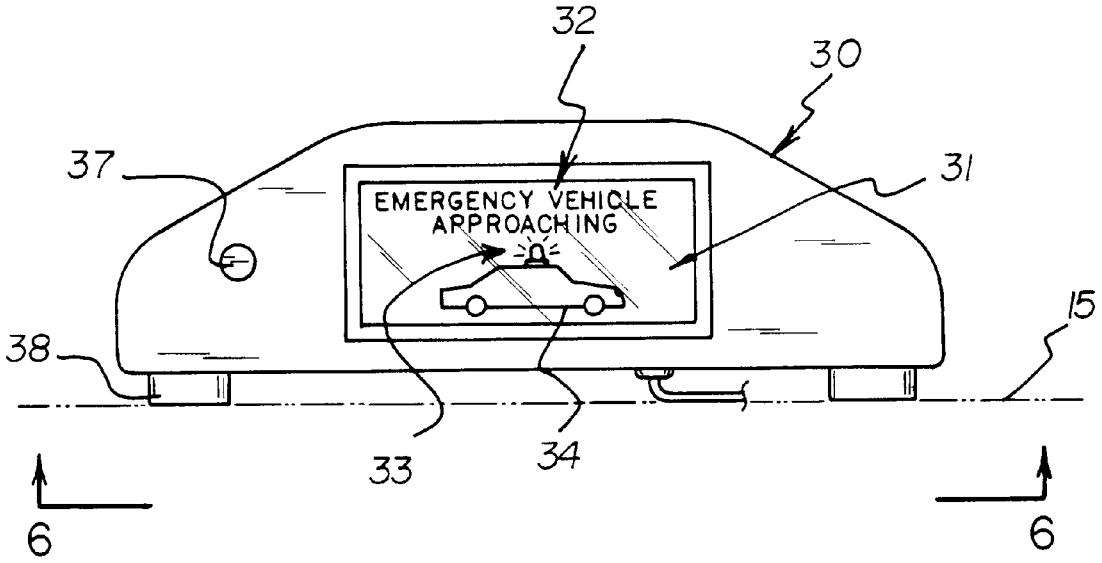
FIG. 5 is a front view of the signal receiver.
Figure 6:
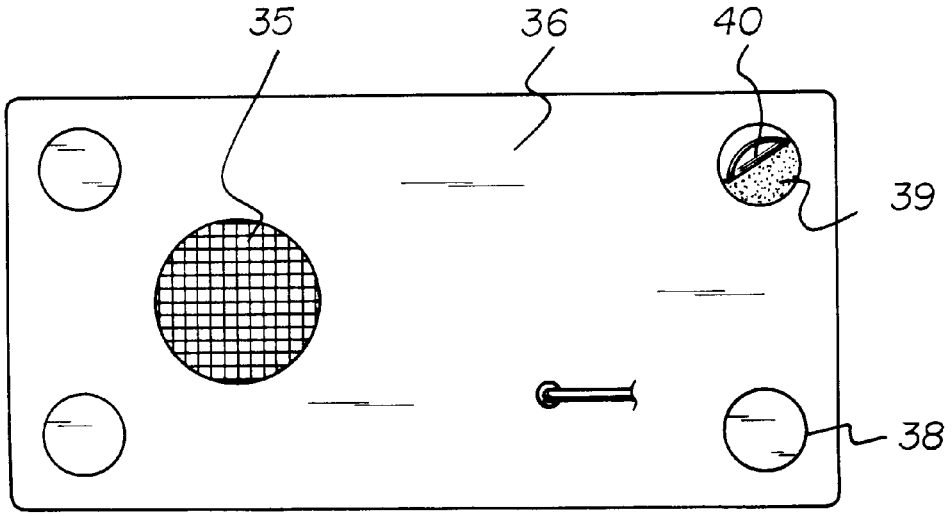
FIG. 6 is a view taken along line 6—6 of FIG. 5.

With reference now to the drawings, and in particular to FIGS. 1 through 6 thereof, a new Emergency Vehicle Warning System embodying the principles and concepts of the present invention and generally designated by the reference numeral 10 will be described.

More specifically, it will be noted that the Emergency Vehicle Warning System 10 comprises a signal transmitter 20 mounted within an emergency vehicle 12 and a signal receiver 30 mounted within other vehicles 14, such as passenger vehicles and other non-emergency vehicles, and within other emergency vehicles themselves. It should be noted that the receiver could also be used on bicycles, motorcycles, and the like, to warn of the approach of emergency vehicles.

As best illustrated in FIGS. 1 through 6, it can be shown that the transmitter 20 is mounted inside of the emergency vehicle 12 on any appropriate surface 13, such as on top of the dashboard. The transmitter is designed to emit a warning signal at a predetermined frequency, particularly a frequency within the ranges reserved for public safety vehicles. The specifics of the circuitry of such transmitting devices are well known in the art. Attention is drawn to U.S. Pat. Nos. 5,307,060, 4,537,522, 4,438,429, and 4,764,978 for the details of transmitter circuitry, the disclosures of which are hereby incorporated by reference.

The transmitter 20 includes an on-off switch 21 on the front thereof, permitting the emergency vehicle personnel to selectively operate the transmitter and thus the signal. The switch 21 is provided in the circuitry in a manner which would be obvious to one having ordinary skill in the art such that when the switch is "on" the signal is transmitted, and when the switch is "off" the signal is not transmitted. The switch 21 includes a textured surface 22 so that a finger will not slip while actuating the switch. Indicator light 23, which can for instance be red, is also provided on the front of the transmitter for indicating the position of the switch 21. Preferably, the light is provided in the circuitry such that the light is "on" when the switch is "on", and the light is "off" when the switch is "off".

The bottom 24 of the transmitter is provided with rubber pads 25 in order to prevent transmission of vibrations when the transmitter is mounted on surface 13. The pads include an adhesive 26 for securely attaching the transmitter to the surface 13, and a removable covering 27 on the adhesive which is removed before mounting the transmitter.

The receiver 30 is mounted inside of the vehicle 14 on any appropriate surface 15, such as on top of the dashboard. The receiver is designed to receive the signal emitted by the transmitter 20. The specifics of the circuitry of such receiving devices are well known in the art. Attention is drawn to U.S. Pat. Nos. 5,307,060, 4,537,522, 4,438,429, and 4,764,978 for the details of receiver circuitry, the disclosures of which are hereby incorporated by reference.

The receiver includes a display screen 31 which displays both an illuminated message 32 and a flashing indicator light 33 indicating the approach of the emergency vehicle. The message 32 can be permanently located on the screen 31 in a prominent color, such as red, but which is back lit by a light when the signal is received, in order to prominently display the message. The flashing light 33 is located on the screen such that it is disposed on top of an outline of a vehicle 34, thus mimicking the flashing of an emergency vehicles lights. The flashing light 33 is preferably a red LED provided in the receiver circuitry such that it flashes upon receipt of the signal.

The screen 31 thus provides a dual visual indication system warning of an approaching emergency vehicle. Since a constantly illuminated signal such as the message 32 is sometimes not readily noticed, the flashing light 33 provides a redundant illuminated warning. A flashing light is usually more noticeable by a person than a constant light (note flashing lights on vehicles and at railroad crossings). The driver therefore readily notices the flashing light 33 if the message 32 is not noticed, thus giving the driver more warning time.

It should of course be realized that the receiver unit 30 could utilize either one of the message signal 32 or the flashing light 33 alone without the other signal.

The receiver also includes an audible warning mechanism in the circuitry (U.S. Pat. Nos. 5,307,060, and 4,438,429 incorporated previously) which emits an audible warning from speaker 35 in the bottom surface 36 of the receiver. However, the receiver also includes an audible warning signal cancel button 37 in the front thereof, which is pressed to turn the audible signal off. Once the audible signal sounds and the driver becomes aware of the approaching emergency vehicle, the audible signal is no longer required. Therefore the button 37 is provided so that the signal can be turned off by the driver.

As with the transmitter, the bottom surface 36 of the receiver includes rubber pads 38, adhesive 39, and removable coverings 40.

Figure 7:
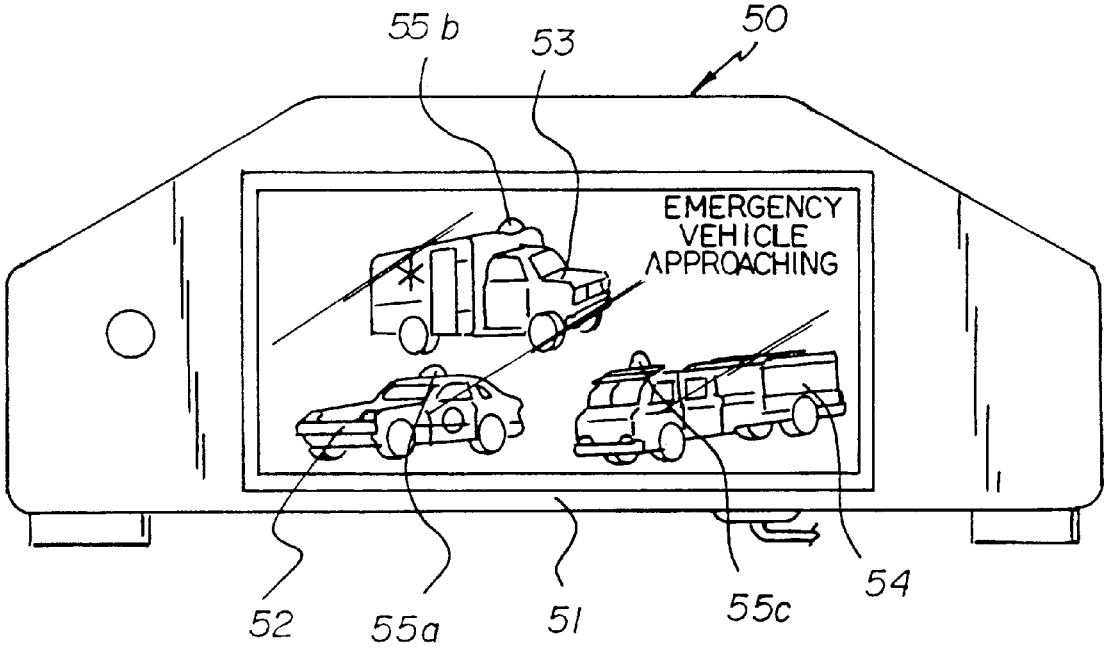
FIG. 7 shows a front view of an alternate embodiment of the signal receiver.

An alternate embodiment of a signal receiver 50 is illustrated in FIG. 7. In this receiver 50, the receiver is generally rectangular and includes a front display screen 51. The screen 51 is provided with the pictures of three different emergency vehicles, such as a police car 52, ambulance 53, and a fire truck 54. Each of the vehicles includes a flashing LED 55*a,b,c* located at the top of the pictures. This embodiment functions with transmitters mounted within the emergency vehicles which transmits a specific signal or range of signals based upon the type of vehicle the transmitter is mounted in. Therefore, a transmitter in a police car will transmit one signal or range of signals, a transmitter in an ambulance another signal, and a transmitter in a fire truck another. The receiver 50 includes circuitry therein which detects a transmitted signal, and based upon which signal is received, actuates the LED 55*a,b,c* disposed on top of the vehicle picture so as to indicate not only the approach of an emergency vehicle, but also the kind of approaching vehicle. For instance, when the receiver 50 detects a signal from a police car, the LED 55*a* is actuated, indicating that a police car is approaching. The circuitry of such a receiver 50 is believed to be obvious to one having ordinary skill in the art and is therefore not further described.

The receiver 50 is otherwise similar to the receiver 30, including audible signaling, and audible signal canceling, capabilities.

In use, the transmitter emits a signal when the switch 21 is "on". The receiver 30 receives the signal and the screen provides a warning message 32 and a flashing warning light 33 indicating the emergency vehicle. The receiver also emits an audible warning signal. Once the driver of the vehicle becomes aware of the signals, the audible signal is turned off since it has served its purpose. The receiver 50 functions in a similar manner, but a single one of the lights 55*a,b,c* will be actuated, depending upon the signal received, so as to indicate the type of approaching emergency vehicle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. In an emergency vehicle warning system, the system including a transmitter inside of an emergency vehicle, the transmitter emitting a signal at a predetermined frequency, and a receiver inside of another vehicle adapted to receive the emitted signal and provide a warning signal to the driver of the vehicle upon receipt of the signal, the improvement comprising:

a single message screen on a front of the receiver, the single message screen including graphical representations of emergency vehicles, said graphical representations including an ambulance, a police car, and a fire truck;

said single message screen being adapted to illuminate one of said graphical representations corresponding to a signal transmitted from the transmitter on one type of emergency vehicle and received by the receiver;

a speaker positioned on a bottom surface of the receiver for preventing contaminants from entering into the speaker thereby inhibiting use of the speaker, wherein the receiver further emits an audible warning signal through the speaker upon signal receipt;

an audible warning signal cancel button being disposed on the front of the receiver for stopping the audible warning signal;

wherein the receiver includes rubber support pads on a bottom surface thereof for supporting the receiver in a spaced relationship on a vehicle surface to prevent muffling of the speaker by the vehicle surface, and adhesive on the pads for attaching the receiver to the vehicle surface such that the single message screen is viewable by a user;

wherein the transmitter includes an on-off switch for selectively controlling the emitted signal, and an indicating light indicating the position of the switch; and wherein the transmitter includes rubber support pads on a bottom surface thereof for supporting the transmitter on a surface of the emergency vehicle, and adhesive on the pads for attaching the transmitter to the emergency vehicles surface.

2. In an emergency vehicle warning system, the system including a transmitter inside of an emergency vehicle, the transmitter emitting a signal at a predetermined frequency, and a receiver inside of another vehicle adapted to receive the emitted signal and provide a warning signal to the driver of the vehicle upon receipt of the signal, the improvement comprising:

a single message screen on a front of the receiver, the single message screen including graphical representations of emergency vehicles, said graphical representations including an ambulance, a police car, and a fire truck;

said single message screen being adapted to illuminate one of said graphical representations corresponding to a signal transmitted from the transmitter on one type of emergency vehicle and received by the receiver;

a speaker positioned on a bottom surface of the receiver, wherein the receiver further emits an audible warning signal through the speaker upon signal receipt;

an audible warning signal cancel button being disposed on the front of the receiver for stopping the audible warning signal;

wherein the receiver includes rubber support pads on a bottom surface thereof for supporting the receiver in a spaced relationship on a vehicle surface to prevent muffling of the speaker by the vehicle surface, and adhesive on the pads for attaching the receiver to the vehicle surface such that the single message screen is viewable by a user;

wherein the transmitter includes an on-off switch for selectively controlling the emitted signal, and an indicating light indicating the position of the switch; and wherein the transmitter includes rubber support pads on a bottom surface thereof for supporting the transmitter on a surface of the emergency vehicle, and adhesive on the pads for attaching the transmitter to the emergency vehicles surface.

3. In an emergency vehicle warning system, the system including a transmitter inside of an emergency vehicle emitting a signal at a predetermined frequency, and a receiver inside of another vehicle adapted to receive the emitted signal and provide a warning signal to the driver of the vehicle upon receipt of the signal, the improvement comprising:

a message screen on a front of the receiver, said message screen including the images of a plurality of different types of emergency vehicles;

a speaker positioned on a bottom surface of the receiver for preventing contaminants from entering into the speaker thereby inhibiting use of the speaker;

said message screen being adapted to illuminate one of said emergency vehicle images corresponding to a signal transmitted from a transmitter on one type of emergency vehicle and received by the receiver.

4. The improved emergency vehicle warning system of claim 3, wherein the receiver further emits an audible warning signal upon signal receipt, and an audible warning signal cancel button disposed on the front of the receiver for stopping the audible warning signal.

5. The improved emergency vehicle warning system of claim 4, wherein the receiver includes rubber support pads on a bottom surface thereof for supporting the receiver on a vehicle surface, and adhesive on the pads for attaching the receiver to the vehicle surface.

6. The improved emergency vehicle warning system of claim 5, wherein the transmitter includes an on-off switch for selectively controlling the emitted signal, and an indicating light indicating the position of the switch.

7. The improved emergency vehicle warning system of claim 6, wherein the transmitter includes rubber support pads on a bottom surface thereof for supporting the transmitter on a surface of the emergency vehicle, and adhesive on the pads for attaching the transmitter to the emergency vehicles surface.

* * * * *